United States Patent [19]

Mix

[11] Patent Number: 4,632,734

[45] Date of Patent: Dec. 30, 1986

[54] PROCESS FOR ELECTROCHEMICALLY OR CHEMICALLY COATING NIOBIUM

[75] Inventor: Holger Mix, Hamburg, Fed. Rep. of Germany

[73] Assignee: Deutsche Lufthansa AG, Cologne, Fed. Rep. of Germany

[21] Appl. No.: 712,177

[22] Filed: Mar. 15, 1985

[30] Foreign Application Priority Data

Mar. 21, 1984 [DE] Fed. Rep. of Germany ..... 3410243

[51] Int. Cl.[4] ..... C25D 5/38

[52] U.S. Cl. ..... 204/32.1; 204/29; 204/38.5; 204/40; 427/328

[58] Field of Search ..... 204/29, 32.1, 35.1, 204/38.5, 40; 427/309, 328

[56] References Cited

U.S. PATENT DOCUMENTS

| | | | |
|---|---|---|---|
| 2,835,630 | 5/1958 | Huddle et al. | 204/1.5 |
| 3,314,867 | 4/1967 | Gore et al. | 204/32.1 |
| 3,582,479 | 6/1971 | Urban et al. | 204/32.1 |
| 3,866,315 | 2/1975 | Ziemek | 29/599 |

*Primary Examiner*—John F. Niebling
*Assistant Examiner*—William T. Leader
*Attorney, Agent, or Firm*—Wegner & Bretschneider

[57] ABSTRACT

Niobium is electrochemically or chemically coated by subjecting work pieces made of niobium to a blast treatment with aluminium oxide, a treatment with an alkaline cyanide bath, a preliminary nickel deposition treatment using an acidic nickel chloride bath, another treatment with an alkaline cyanide bath, and thereafter to an electrochemical or chemical coating treatment with the desired metal in a per se known manner. To properties of the coatings, more specifically, satisfy the requirements as set for supra-conductive materials.

6 Claims, No Drawings

PROCESS FOR ELECTROCHEMICALLY OR CHEMICALLY COATING NIOBIUM

BACKGROUND OF THE INVENTION

The present invention relates to a process for the electrochemical and chemical coating of niobium. More specifically, the process is suitable for applying coatings of silver, copper, nickel, or chromium.

Niobium, in addition to molybdenum, tantalum, and tungsten, is one of the metals which retains a high strength even at a high temperature. However, putting niobium into practical use has mostly failed because it has not been successfully accomplished to sufficiently protect the surface of niobium from oxidation processes; all the more so as any oxides formed on the surface do not provide any protection against a further rapid oxidation. Thus, although much work has been done on the protection against oxidation of the high-melting metals, only partial success has been achieved in narrowly limited fields of application.

DISCUSSION OF PRIOR ART

Electrolytic nickel-plating has been proven relatively suitable, wherein the material is cleaned with a sodium hydroxide solution, pickled with a 1:1 nitric acidhydrofluoric acid mixture, pre-nickelized using a nickel chloride bath, and then depositing a thick nickel coating from a sulfuric acid-nickel sulfate bath; cf. Dettner-/Elze, Handbuch der Galvanotechnik, Raumfahrtindustrie 1964, pp. 1007–1010. The protection of turbine blades made of niobium from oxidation has so far not been successfully accomplished, in spite of research conducted during many tens of years, because of the problem of oxidation protection, even after low-pressure plasma spraying has shown some substantial advance; cf. Kuno Kirner, Robert Bosch GmbH, Reprint of the papers given during the Surtec Congress 1981, Section "Protection from Oxidation of Turbine Blades". Eventually, there has been known from the Reactor Handbook, Vol. 1, Materials Interscience Publishers Inc., New York 1960, p. 628, that niobium can be electrolytically coated with iron or nickel, respectively, while, however, it has been explicitly noted that the nickel layer does adhere less well than the iron layer does.

Another field of use for niobium is the use for supra-conducting resonators, as niobium becomes supra-conductive at already relative high temperatures. Also in this use the property of being readily oxidizable is disadvantageous; all the more so as the oxide layer has a smaller heat conductivity and, thus, prevents a rapid transfer of heat to the coolant to occur. Thus, also for this intended use it appears to be necessary to coat the surface so well that an oxidation is prevented and a good heat conductivity is ensured. The respective coatings have to retain their good properties with respect to protection, adhesion, and durability throughout a wide temperature spectrum, namely from −170° C. to +730° C. The upper temperature range is necessary in order to join work pieces made of niobium with work pieces made of other materials at least by soldering. Re-working the processes as described in the literature for electrolytrically plating niobium in no case resulted in a formation of stable and coherent coatings which, moreover, would have been able to stand the temperature stresses as well. Plasma coatings also did not yield any satisfactory results, as the adhesion between niobium and the plasma layer was insufficient.

SUMMARY OF THE INVENTION

Accordingly, it is the object of the invention to develop a process for electrochemical and chemical coating of niobium, by which process coatings are formed that adhere well, prevent niobium from being oxidized, ensure a good heat conductivity to be obtained, and will also survive temperature stresses through a range of from −170° C. to +730° C.

After many unsuccessful attempts which had already created the impression that the problem is insurmountable, it has now suprisingly been found that the object can be attained by subjecting the work pieces made of niobium to (a) blast treatment with aluminium oxide,
(b) a treatment with an alkaline cyanide bath,
(c) an electrolytic preliminary nickel deposition using an acidic nickel chloride bath,
(d) another treatment with an alkaline cyanide bath, and thereafter
(e) an electrochemical or chemical coating treatment with the desired metal in a per se known manner.

It is preferred that between the steps (b), (c), (d), and (e) respectively, steps of rinsing with water are inserted, whereby a release of hydrocyanic acid is prevented and the use-life of the individual baths is significantly prolonged.

More specifically, for supra-conducting resonators made of niobium, a relatively thick coating with silver amounting up to a thickness of 400 μm has proven to be useful. Such coating is applied by that in step (e) first a pre-treatment of electrolytic silver-plating is effected and then an after-treatment of electrolytic silver-plating is carried out.

It has futher been found that the Niobium work pieces pretreated in accordance with the steps (a) through (d) are not only suitable for being silver-plated, but that, in an excellent manner, they also can be electrochemically or chemically coated with a plating of copper, nickel, or chromium. Thus, basically it is possible in a per se known way to electrochemically or chemically build up all of the other metal layers adhering to nickel on the thin nickel layer as obtained in accordance with the steps (a) through (d). This opens a chance to coat and technically employ niobium for the most various fields of use.

DETAILED DESCRIPTION OF THE INVENTION

In carrying out the process according to the present invention, in the first step (a) the niobium work piece is blast-treated using aluminum oxide. A particle size of the aluminum oxide of 36# through 230# has proven to be useful. This step appears to be absolutely necessary, since layers on unblasted work pieces made of niobium do not have the required adhesion strength.

Treatment with an alkaline cyanide bath in accordance with step (b) also appears to be indispensable, as work pieces treated without this intermediate step are not provided with sufficiently adhering layers in the acidic pre-nickelation. Typical alkaline cyanide baths contain 7.5 to 15 g/l of NaOH and 30 to 37 g/l of NaCN.

The electrolytic preliminary nickel deposition using an acidic nickel chloride bath is effected in a per se known manner. The respective baths in general contain at least 50 g/l of nickel and 33 to 51 g/l of HCl and are operated at room temperature. The pre-nickelation is usually carried out at a voltage of from 4 to 6 volts and at a current density of from 3.8 to 8 A/dm$^2$.

After the preliminary nickel deposition, in step (d) the work piece is once more treated with an alkaline cyanide bath, and thereafter the further layer is electrochemically or chemically built up in a per se known manner.

In order to form a silver layer structure, it is preferred initially to apply a pre-treatment of silver-plating using a silver bath containing 1.5 to 3 g/l of silver and about 70 g/l of potassium cyanide. The silver bath is operated at room temperature at a voltage of from 3 to 4 volts. Then, onto the layer as thus obtained, a thick silver layer having a thickness of up to 400 μm can be applied, for example from a silver bath containing 37 to 70 g/l of silver, 60 to 90 g/l of potassium cyanide, 4 to 15 g/l of KOH, and 30 g/l of $K_2CO_3$. It is operated at room temperature using a current density of from 1 to 2 A/dm$^2$.

In the place of a silver coating, a thicker nickel layer may also be electrolytically applied. A typical nickel sulfamate bath used therefor contains 75 to 90 g/l of nickel, 8 to 25 g/l of nickel chloride, and 37 to 40 g/l of boric acid. The pH value should be about 4.3. The nickel sulfamate bath is operated at 50° C., at a voltage of from 2 to 4 volts, and at current densities of from 2.5 to 7.5 A/dm$^2$.

A bath suitable for copper-plating contains 14 to 30 g/l of copper, 4 to 11 g/l of NaOH, and 8 to 22 g/l of NaCN. The bath is operated at about 50° C. and at current densities of from 1 to 3 A/dm$^2$.

For plating with chromium, there may conveniently be used a bath containing 245 to 255 g/l of $CrO_3$, 0.8 to 1.2 g/l of $H_2SO_4$, and 3 to 10 g/l of $Cr_2O_3$. The maximum allowable Fe content is 5 g/l. The bath is operated at a temperature of from 55° C. to 60° C., at a voltage of from 3.5 to 6 volts, and at current densities of from 25 to 30 A/dm$^2$.

In the place of an electrolytic or electrochemical coating procedure, there may also be employed a technique of chemical coating. For example, to this end a chemical nickel bath is suitable that contains 4.5 g/l of nickel and 25 g/l of $NaH_2PO_2.2H_2O$. The bath is used at a pH value of about 4.5 at a temperature of at least 95° C.

The layer thickness of the metals having been electrochemically or chemically deposited always were in the range between 20 and 30 μm which will suffice for most uses. However, it is basically well possible to increase the layer thickness if this appears to be required for technical reasons.

The investigations of the samples prepared in accordance with the present invention have shown in all cases that the work pieces prepared in accordance with present invention satisfy all of the requirements relating to protection from oxidation, heat conductivity, temperature resistance, and adhesion strength, and with respect thereto are distinguished to a significant extent from the work pieces treated in accordance with prior art.

The present invention is illustrated in detail by means of the following non-limiting examples.

EXAMPLE 1

Straight and bent work pieces made of niobium were blast-treated with aluminum oxide 36# and then immersed in an alkaline cyanide bath for 5 minutes. The cyanide bath contained 11 g/l of NaOH and 35 g/l of NaCN. Experiments using cyanide baths containing from 7.5 to 15 g/l of NaOH and from 30 to 37 g/l of NaCN lead to equally good results. The work pieces were rinsed with water and then pre-nickeled in an acidic nickel chloride bath. The bath contained at least 50 g/l of nickel and 42 g/l of HCl. Baths containing more nickel and having a HCl content of from 33 to 51 g/l yielded equally good results. The nickel-plating pre-treatment was conducted at 30° C., at a voltage of 4 to 6 volts and at a current density of 3.8 to 8 A/dm$^2$. Then the work pieces were washed with water and once more treated with the alkaline cyanide bath.

Thereafter, the work pieces were subjected to a silver-plating pre-treatment using a bath containing 1.5 g/l of Ag and 70 g/l of KCN. It was operated at room temperature and at a voltage of from 3 to 4 volts. Immediately thereafter, silver-plating of the work-pieces was continued in a bath containing 70 g/l of Ag, 85 g/l of KCN, 5 g/l of KOH, and 30 g/l of $K_2CO_3$. The bath was operated employing room temperature and a current density of 1 to 2 A/dm$^2$, whereby layers 400 μm in thickness were obtained. Trials using silver concentrations of from 37 to 70 g/l, KCN concentrations of from 60 to 90 g/l and KOH concentrations of from 4 to 15 g/l yielded equally good results.

The obtained work pieces were subjected to heat shock tests, bending tests, and soldering tests and proved to be unobjectionable in all respects.

EXAMPLE 2

Work pieces made of niobium were pre-treated according to Example 1 and then electrolytically nickel-plated. To this end, a nickel sulfamate bath was used that contained 75 g/l of nickel, 8 to 25 g/l of $NiCl_2.H_2O$, and 40 g/l of $H_3BO_3$. The pH value was 4.3. The bath was operated at 50° C., at a voltage of 2 to 4 volts, and at a current density of from 2.5 to 7.5 A/dm$^2$. Further runs using a nickel content of 90 g/l and boric acid contents of 37 g/l were equally successful with good results (temperature stress test: 1000° C. in air, 1 hour).

EXAMPLE 3

Work pieces pre-treated according to Example 1 were immersed in a 95° C. chemical nickel bath that contained 4.5 g/l of nickel and 25 g/l of $NaH_2PO_2.2H_2O$. The pH value was 4.5. The layer thickness was about 20 μm. The obtained layers met all of the requirements as set.

EXAMPLE 4

Work pieces pre-treated according to Example 1 were electrolytically copper-plated in a bath containing 25 g/l of copper, 10 g/l of NaOH, and 14 g/l of NaCN. The temperature was 49° C. to 54° C., and the current density was from 1 to 3 A/dm$^2$. Further runs using a copper content of from 14 to 30 g/l, a NaOH content of from 4 to 11 g/l, and a NaCN content of from 8 to 22 g/l were equally successful with good results. The layer thicknesses were up to 30 μm, and the obtained layers had the desired properties.

EXAMPLE 5

Work pieces pre-treated according to Example 1 were electrolytically chromium-plated in a bath containing 255 g/l of $CrO_3$, 2.5 g/l of $H_2SO_4$, 5 g/l of $Cr_2O_3$, and a maximum of 5 g/l of Fe. The temperature was 55° C. to 60° C., the voltage was from 3.5 to 6 volts, and the current density was from 25 to 30 A/dm$^2$. Further runs using concentrations of 245 g/l of $CrO_3$, 0.8 g/l of $H_2SO_4$, and from 3 to 10 g/l of $Cr_2O_3$ also led to good results.

What is claimed is:

1. A process for electrochemically or chemically metal coating niobium, comprising (a) blast treatment of a niobium work piece with aluminium oxide, (b) treating the blast prepared work piece of step (a) with an alkaline cyanide bath, (c) subjecting the treated work piece of step (b) to a preliminary electrolytic nickel deposition treatment using an acidic nickel chloride bath, (d) subjecting the treated work piece of step (c) to another treatment with an alkaline cyanide bath, and thereafter (e) undertaking an electrochemical or chemical coating treatment with a metal.

2. The process of claim 1, further comprising undertaking a step of rinsing with water between each of the steps (b), (c), (d), and (e).

3. The process of claim 2, wherein in step (e) first a pre-treatment of electrolytic silver-plating is effected and then an after-treatment of electrolytic silver-plating up to a layer thickness of 400 μm is carried out.

4. The process of claim 2 wherein said metal is selected from the group consisting of silver, copper, nickel, and chromium.

5. The process of claim 1, wherein in step (e) first a pre-treatment of electrolytic silver-plating is effected and then an after-treatment of electrolytic silver-plating up to a layer thickness of 400 μm is carried out.

6. The process of claim 1, wherein said metal is selected from the group consisting of silver, copper, nickel, and chromium.

* * * * *